US006523207B1

(12) United States Patent
Stubler et al.

(10) Patent No.: US 6,523,207 B1
(45) Date of Patent: Feb. 25, 2003

(54) FIXING DEVICE AND METHOD BETWEEN A STRUCTURAL ELEMENT AND A SUSPENSION CABLE

(75) Inventors: Jérôme Stubler, Paris (FR); Michel Robert Crawford McClenahan, Montigny-le-Bretonneux (FR); Patrick Ladret, Montbrison (FR); Ivica Zivanovic, Arnouville (FR)

(73) Assignee: Freyssinet International (STUP) (FR)

( * ) Notice: Subject to any disclaimer, the term of this patent is extended or adjusted under 35 U.S.C. 154(b) by 0 days.

(21) Appl. No.: 09/869,225

(22) PCT Filed: Dec. 20, 1999

(86) PCT No.: PCT/FR99/03200

§ 371 (c)(1),
(2), (4) Date: Jun. 25, 2001

(87) PCT Pub. No.: WO00/39401

PCT Pub. Date: Jul. 6, 2000

(30) Foreign Application Priority Data

Dec. 24, 1998 (FR) ..... 98 16448
Jun. 23, 1999 (EP) ..... 99401563

(51) Int. Cl.[7] ..... S01D 19/16
(52) U.S. Cl. ..... 14/22
(58) Field of Search ..... 14/23, 22, 21, 14/20, 19, 18

(56) References Cited

U.S. PATENT DOCUMENTS

| | | | | | |
|---|---|---|---|---|---|
| 440,490 | A | * | 11/1890 | Mitchell | 14/22 |
| 511,605 | A | * | 12/1893 | Frederick | 14/19 |
| 1,293,383 | A | * | 2/1919 | Eaton | 14/22 |
| 1,811,154 | A | * | 6/1931 | Reilly | 14/22 |
| 1,951,687 | A | * | 3/1934 | Zapf | 14/22 |
| 2,011,168 | A | * | 8/1935 | Sunderland | 14/22 |
| 2,057,328 | A | * | 10/1936 | Cordova | 14/22 |
| 2,748,407 | A | * | 6/1956 | Copp | 14/22 |
| 3,531,811 | A | * | 10/1970 | Baker | 14/23 |
| 4,457,035 | A | * | 7/1984 | Habegger et al. | 14/18 |
| 4,473,915 | A | * | 10/1984 | Finsterwalder | 14/18 |
| 4,648,147 | A | * | 3/1987 | Zimmermann et al. | 14/21 |
| 5,803,641 | A | * | 9/1998 | Nutzel | 14/22 |
| 6,138,309 | A | * | 10/2000 | Tadros et al. | 14/22 |
| 6,301,735 | B1 | * | 10/2001 | Jartoux et al. | 14/20 |

FOREIGN PATENT DOCUMENTS

| | | |
|---|---|---|
| DE | 869 977 | 3/1953 |
| EP | 0 789 110 | 8/1997 |
| EP | 0 855 471 | 7/1998 |

* cited by examiner

*Primary Examiner*—Thomas B. Will
*Assistant Examiner*—Raymond W Addie
(74) *Attorney, Agent, or Firm*—Cantor Colburn LLP

(57) ABSTRACT

A device comprising a rigid housing connected to the structural element and enclosing at least partially the cable, a wedging structure arranged between the cable and the housing, load transmitting device arranged to exert a longitudinal compressive stress, parallel to the cable, on the wedging structure. The wedging structure is pressed against the cable and the housing under the action of the longitudinal compressive stress, so as to provide resistance to the movement of the housing and the structural element parallel to the cable.

32 Claims, 3 Drawing Sheets

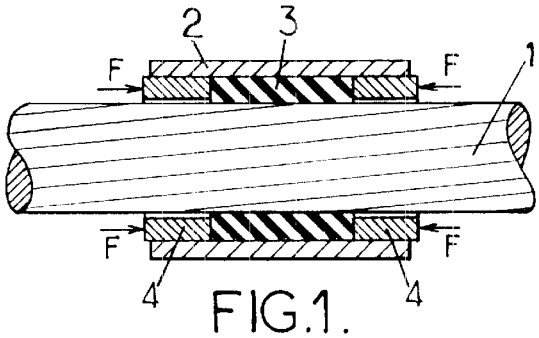
FIG.1.
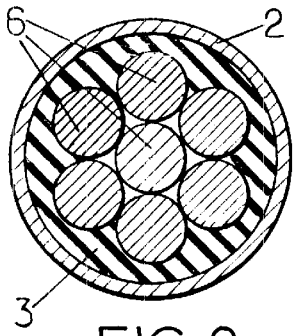
FIG.2.
FIG.3.
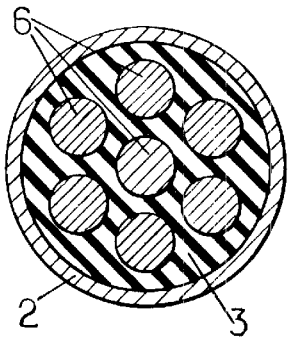
FIG.4.
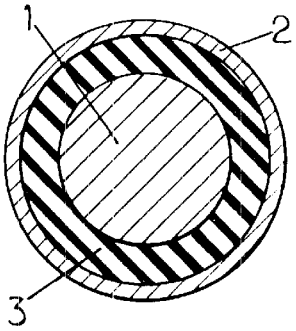
FIG.5.
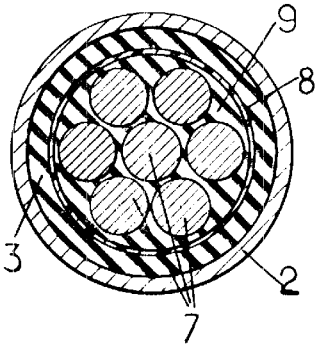
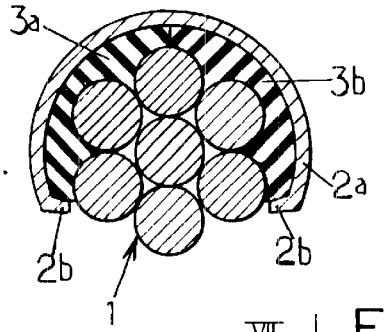
FIG.6.
FIG.7.
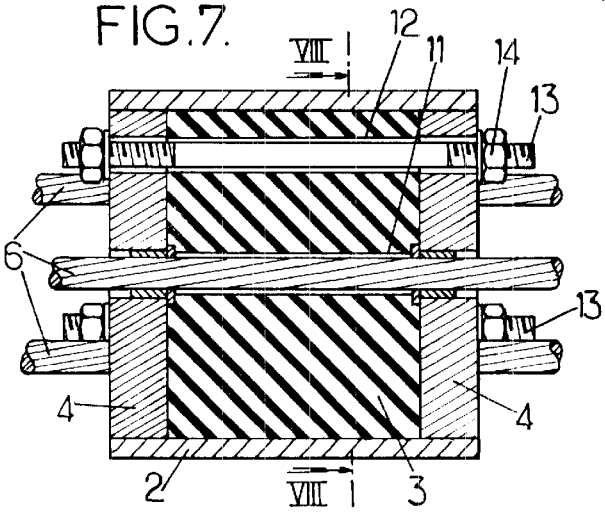
FIG.8.
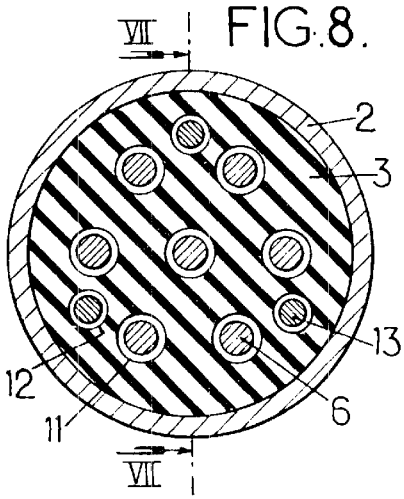

FIXING DEVICE AND METHOD BETWEEN A STRUCTURAL ELEMENT AND A SUSPENSION CABLE

BACKGROUND OF THE INVENTION

The present invention relates to the field of the use of cable in constructions.

It finds an application each time it is necessary to retain a construction element with respect to a structural cable, or alternatively to retain the structural cable with respect to the construction element, so as to avoid relative movements thereof parallel to the direction of the cable.

The term "structural cable" as used here also covers a bundle or group of individual cables roughly parallel to one another, it being possible for each individual cable itself to be made up of one or more elemental wires. The cable or the individual cables may be bare or individually sheathed, or alternatively may consist of a mixture of these two types. The cable may possibly be contained in an overall external protective sheath filled with an adhesive material. In the case of a cable formed by a group of individual cables, these may be in direct contact with one another or may be spaced apart.

The invention can be implemented in particular in suspension bridges comprising one or more suspension cables which have to be immobilized with respect to certain elements (the tops of towers, etc), and to which certain other elements (deck hangers, sections integral with the deck, etc) need to be attached.

The invention can also be applied to the field of prestressing, the structural cable then consisting in a cable that is tensioned in order to exert prestressing forces on a construction made of concrete or some other material, and to which certain elements of the construction can be fixed.

In the fixing area, the interface that the cable exhibits to its environment is generally defined by generators which are essentially parallel to the longitudinal direction. Under these conditions, in order to prevent relative longitudinal movements between the cable and the element, a transverse clamping force has to be exerted on the cable in order to obtain sufficient friction at the interface.

This clamping can be obtained using wedge-effect jaws, particularly to anchor structural cables. In the common case of a multi-strand cable, the jaws are installed individually around the strands, which entails that these can be parted from one another, a condition which is not always fulfilled in practice.

Otherwise, clamping is habitually exerted using collars comprising two (or more) shells, urged toward one another by means of bolts or the like. The inside of the shells has a shape corresponding to the external interface of the cable, possibly supplemented by filler inserts.

This approach leads to a non-uniform transmission of clamping forces across the section of the structural cable, even though it is possible to combat this disadvantage by appropriate filling of the inside of the collar (see EP A-0 789 110). Around the periphery of the cable, the areas next to the gaps that separate the shells tend to be less heavily loaded than the others. What this means is that in order to obtain a nominal clamping value, excessive clamping needs to be applied, this being undesirable as far as the reliability of the device and the integrity of the cable are concerned. Along the cable, the collar transmits maximum force in the region of the bolts, of which there have therefore have to be many if the collar is relatively long. Furthermore, applying transverse clamping stresses to the shells entails these having an accordingly robust structure and thickness, which makes the fixing device relatively heavy.

German patent 869 977 proposes securing the fixing of a hanger to the suspension cable of a suspension bridge by adding wedge-effect jaws to the two ends of a collar consisting of several shells clamped together by bolts. This securing function is rather relative because the wedge effect is largely lost if the bolts that clamp the shells together lose their tightness as a result of creep or fatigue. Furthermore, the distribution of the clamping forces is not well controlled if these bolts are retightened. In addition, this device presents the bulk and weight problems customarily posed by this type of collar.

SUMMARY OF THE INVENTION

Another disadvantage of the collar in German patent 869 977 is that clamping is achieved by moving the jaws toward one another parallel to the cable. This results in significant friction at the surface of the cable, this being all the more exacerbated since the interior face of the jaws has to be rough in order to grip the cable firmly. This is already problematical in itself with bare metal wires and is clearly unacceptable when the cable or its constituent wires are coated with a plastic sheath.

One object of the present invention is to propose a fixing method which suitably distributes the forces transmitted to the structural cable.

The invention therefore proposes a device for fixing together a construction element and a structural cable, comprising a rigid housing connected to the construction element and consisting of a one-piece part which completely surrounds a portion of the cable, a wedging structure arranged between the cable and housing, and load transmitting means designed to exert a longitudinal compressive force parallel to the cable, on the wedging structure, the wedging structure being pressed against the cable and the housing under the action of the longitudinal compressive force, so as to offer resistance to the movement of the housing and of the construction element parallel to the cable.

The cable is gripped by the friction that results from the orthogonal contact pressures generated by the longitudinal compression of the structure contained between the rigid outer housing and the cable passing through it.

The load transmitting means make it possible to control the integrity of the fixing and the precise positioning of the housing with respect to the cable. Minimum compressive force can be applied before the device is definitively mounted, or during this mounting prior to the application of load.

The wedging structure must naturally have sufficient compressive strength and shear strength. Its longitudinal displacement when the compression is applied results in uniform radial clamping of the cable.

This wedging structure may be made up of rigid elements such as frustoconical keys, which generate the clamping force as the axial compression is applied, because of the reaction exerted by the frustoconical orifice of the housing in which they are engaged. As a preference, just one end of the housing has a frustoconical orifice receiving a frustoconical jaw urged toward the opposite end of the housing. Thus, when force is applied, the jaw does not rub against the cable. It is rather the housing which moves toward the largest-section end of the jaw in order to press it against the cable without damaging the latter.

Uniform transmission of the forces at the interface between the wedging structure and the cable can be made even easier when the wedging structure undergoes a certain amount of deformation at the time when the load transmitting means exert the controlled longitudinal compression.

This deformation may consist in limited creep of the material of which the wedging structure is formed, which may in particular have the shape of a frustoconical jaw. The limited creep may also occur at the housing or at an insert arranged around a rigid frustoconical jaw.

According to another possibility, the deformation is due to the intrinsically deformable nature of all or part of the wedging structure housed between the housing and the cable. This structure may then comprise an elastic material, a granular material, a fibrous material or alternatively a mixture of such materials, and may be made in one or more pieces. It has the property of expanding in the direction or directions orthogonal to the direction or directions of compression, either through intrinsic elastic movement or through the movement of the individual particles (fibrous and/or granular) with respect to each other or with respect to a binder. The deformable structure has a fairly high shear strength when compressed between the housing and the cable, so as to oppose relative longitudinal movement of these items.

The housing acts as a thrust face for the wedging structure and for the piece for connecting with the element to be fixed to the cable. It is a one-piece part, for example cylindrical on a circular or polygonal base, which completely surrounds a portion of the cable. This housing may be made of a metal or any other sufficiently rigid material. It has the advantage of being able to be of a relatively lightweight construction.

The longitudinal compression is transmitted to the wedging structure by means of plates or rings or other parts bearing on the end surfaces of the wedging structure. The compression may be applied at one end, the other bearing against a stop integral with the housing, or to both ends of the wedging structure, over all or just part of the accessible surface.

The load transmitting means may comprise one or more members running parallel to the cable, tensioned by tightening means so as to exert the longitudinal compressive force to the ends of the wedging structure. These tension members (bolts, prestressing strands or any other appropriate member) may pass through the wedging structure or alternatively around it, through or around the outside of the housing. The load transmitting means may also comprise a nut screwed into a screw thread integral with the housing and applied against one end of the wedging structure.

In another embodiment proposed here, a device for fixing together a construction element and a structural cable, comprises a rigid housing connected to the construction element and surrounding the cable, a wedging structure comprising at least one deformable material, and arranged between the cable and housing, and load transmitting means designed to exert a longitudinal compressive force parallel to the cable, on the wedging structure, the wedging structure being pressed against the cable and the housing under the action of the longitudinal compressive force, so as to offer resistance to the movement of the housing and of the construction element parallel to the cable. In this last embodiment, the housing is not necessarily of one piece, although this is preferred. The load transmitting means may be in accordance with those already mentioned. As an alternative, they may be arranged to convert a longitudinal component of the load exerted on the cable by the construction element into a longitudinal compression of the deformable structure.

Other aspects of the invention relate to a method, using a device of the aforementioned type to fix a construction element to a structural cable or, symmetrically, to fix a structural cable to a construction element, and to a suspension bridge.

BRIEF DESCRIPTION OF THE DRAWINGS

Other particular features and advantages of the present invention will become apparent in the description hereinafter of some nonlimiting exemplary embodiments, with reference to the appended drawings, in which:

FIG. 1 is an outline diagram, in longitudinal section, of a fixing device according to the present invention;

FIGS. 2 to 6 are diagrams in cross section of various embodiments of the device of FIG. 1;

FIG. 7 is a diagram in longitudinal section on the plane VII-VII indicated in FIG. 8, of another example of a fixing device according to the invention;

FIG. 8 is a diagram in cross section of this device, on the plane VIII-VIII indicated in FIG. 7;

DETAILED DESCRIPTION OF THE INVENTION

Figure 9:
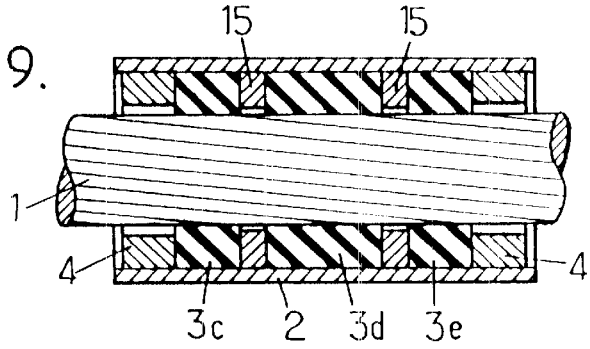
FIGS. 9 to 12 are diagrams in longitudinal section of other examples of fixing devices.

FIGS. 1 and 2 show a fixing device installed around a cable 1, or group of cables. The element to be fixed is attached, by appropriate means which have not been depicted, to a cylindrical housing 2.

A deformable wedging structure 3 which, in the example depicted, has the shape of an elastomer sleeve, is placed around the cable 1 inside the cylindrical housing 2. Two thrust pieces 4, which may be in the form of rings, are applied respectively to the two ends of the deformable structure 3, entering the cylindrical housing 2. A longitudinal compressive force F is exerted on the deformable structure 3 via these two thrust pieces 4. In the example depicted, the force F is applied to each of the two pieces 4 at the two ends of the housing 2.

The deformable structure 3 is housed between the cable and the housing 2 with a certain radial clearance. When urged in compression by the force F, it expands radially so as to become pressed inward against the cable 1 and outward against the cylindrical housing 2. It thus provides friction between the cable 1 and the housing 2 to which the element to be fixed is attached. If the axial compressive force F is high enough, and if the structure 3 has an appropriate shear strength, this friction makes it possible to achieve the desired fixing, preventing relative longitudinal movements between the cable 1 and the housing 4.

In the example of FIG. 2, the cable 1 consists of a collection of juxtaposed wires 6. Each wire 6 may itself be made up of a number of elemental filaments. The deformable structure 3 has a shape that complements the volume lying between the periphery of the cable and the interior face of the housing 2. This shape may be obtained by molding the deformable structure 3 or alternatively by deforming an elastomer sleeve which originally had a cylindrical shape.

In the alternative form in FIG. 3, the constituent wires 6 of the cable 1 are not juxtaposed but are spaced apart. The elastomeric material of the deformable structure 3 is also to be found in the gaps between the wires 6.

In the alternative form in FIG. 4, the cable 1 consists of a solid metal filament of cylindrical cross section. The deformable structure 3 may therefore simply have the shape of a cylindrical sleeve.

In the example of FIG. 5, the cable 1 consists of a strand made up of seven twisted metal filaments 7, protected by a plastic sheath 8, with an adhesive material 9, for example an elastomer, between the filaments 7 and the sheath 8. Such a strand is described in European patent application 0 855 471. The deformable cylindrical sleeve 3 therefore presses against the sheath 8 of the strand. The friction of this sleeve 3 against the housing 2 and the sheath 8 affords the desired fixing, together with the adhesion of the material 9 to the filaments 7 and the sheath 8.

In the examples of FIGS. 2 to 5, the housing 2 is a one-piece part of cylindrical overall shape. The base of this cylindrical shape is circular in the examples depicted, but it is to be noted that it could just as easily be different, particularly polygonal. The fact that the housing 2 is a one-piece part allows it to be of a relatively lightweight construction for a fixing that withstands a given load, particularly more lightweight than if it were formed by assembling several shells in the manner of the conventional collars. In certain configurations, the housing could, however, be an assembly of several parts.

The alternative form of embodiment in FIG. 6 shows that the housing 2*a* to which the element to be fixed is attached can surround the cable 1 only partially. In the example depicted, the cable 1 is surrounded over about 240°, which allows the housing 2*a* to be fitted without the need for it to be slipped over the cable 1 beforehand, this being something which may make it easier to mount in certain instances. Rims 2*b* directed toward the inside are located at the ends of the perimeter of the housing so as to hold the deformable structure between the cable and the housing. FIG. 6 also shows that the deformable structure 3 may consist of several elements 3*a,* 3*b* arranged around the cable 1.

FIGS. 7 and 8 show one possible embodiment of the means for transmitting the longitudinal compression in the case of a cable with a structure of the type depicted in FIG. 3. In this example, the deformable structure 3 consists of a block of elastomeric material through which there pass seven cylindrical passages 11 of a diameter slightly greater than the diameter of the seven constituent wires 6 of the cable, and three other cylindrical passages 12 distributed symmetrically over the cross section of the housing and intended to receive three threaded rods 13 of slightly smaller diameter. The threaded rods 13 pass through corresponding holes made in the thrust pieces 4. The rods 13 protrude from the two ends of the housing 1, where they receive nuts 14. Tightening these nuts tensions the rods 13 so as to exert the longitudinal compression on the deformable structure 3. Under the effect of this compression, the deformable structure 3 bears on the inside of the housing 2 and clamps the wires 6.

As an alternative, the threaded rods 13 could pass outside of the deformable structure 3, through the wall of the housing 2, or around the outside thereof. These rods could alternatively be replaced by other members operating in tension, such as prestressing strands, for example, anchored at their ends by conically tapered keys.

In the advantageous embodiment of FIG. 9, the deformable wedging structure comprises several (in the example depicted, 3) portions of deformable material 3*c,* 3*d,* 3*e* arranged in succession along the cable 1. The end sections 3*c* and 3*e* are loaded in compression by the thrust pieces 4, while rigid inserts 15 are placed between the adjacent sections. These inserts 15 run radially between the cable and the housing. They may in particular be in the form of rings. Their role is to limit the creep of the deformable material of the wedging structure from the side of the cable 1 on which the transverse loadings are applied to the opposite side. They thus act as thrust faces for the cable 1 if such creep occurs, and once this thrust occurs, creep stops because the deformable material is practically no longer stressed transversely. Advantageously, the inserts 15 and the thrust pieces 4 have radial clearances with respect to the cable 1, these being tailored so that the cable follows a constant or practically constant radius of curvature when it bears on these inserts, so as to minimize undesirable curvature.

Figure 10:
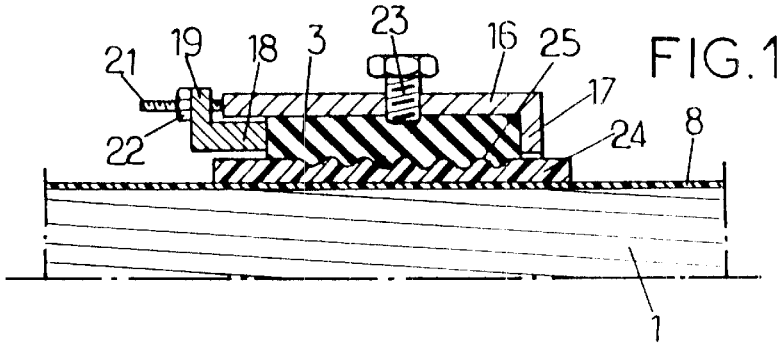

In the embodiment of FIG. 10, the longitudinal compressive force is applied to just one side of the housing 16. At the other end of the housing, the deformable structure 3 is retained by a section integral with the housing 16, such as a rim 17 directed inward, for example. At the end where clamping is applied, the thrust piece 18, in the form of a ring pressing on the deformable structure 3, has a rim 19 directed outward and provided with holes receiving bolts 21 fixed to the housing. The tightening of nuts 22 on to the bolts 21 thus allows the structure 3 to be compressed between the rim 17 and the thrust rings 18.

The fixing device depicted in FIG. 10 comprises an adjusting member penetrating the housing 16 transversely to the direction of the cable. This member consists in a screw 23 which can be made to penetrate the housing 16 more or less deeply in order to vary the volume available for the deformable structure 3, this making it possible to vary the clamping afforded.

In the example of FIG. 10, the cable 1 consists, as mentioned with reference to FIG. 5, of one or more strands protected by an individual plastic sheath 8, for example made of high density polyethylene (HDPE), and the deformable structure 3 is made of elastomer, for example neoprene. A rigid intermediate layer 24 is arranged between the deformable structure 3 and the cable sheath 8, to take account of the mediocre coefficient of friction between the HDPE and the neoprene. This layer 24 may in particular be made of HDPE, the HDPE/HDPE coefficient of friction being better. On its outer face, that is to say toward the deformable structure 3, the intermediate layer 24 has reliefs transversal to the direction of the cable, such as striations 25, so as to increase the friction.

Figure 11:
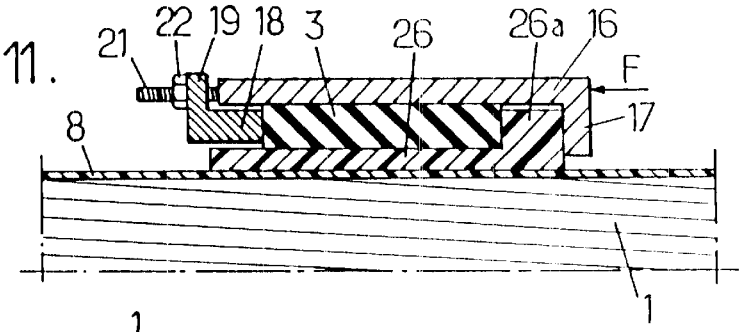

FIG. 11 shows an alternative form of the embodiment according to FIG. 10, in which the rigid intermediate layer 26 ends, on the side of the internal rim 17 of the housing 16, in an external rim 26*a*. The rims 17 and 26*a* are in axial abutment against each other, and the deformable structure 3 is compressed longitudinally between the rim 26*a* and the thrust ring 18, which urges the end of the wedging structure opposite the one which bears against the rim 26*a* toward said rims. This ensures radial clamping between the housing 3 and the intermediate layer 26, the latter transmitting the clamping to the cable 1. In this alternative form, the only interface working in friction is the one between the layer 26 and the cable 1, which makes it possible to dispense with any problem of slippage which may arise at the surface of the deformable material.

Figure 12:
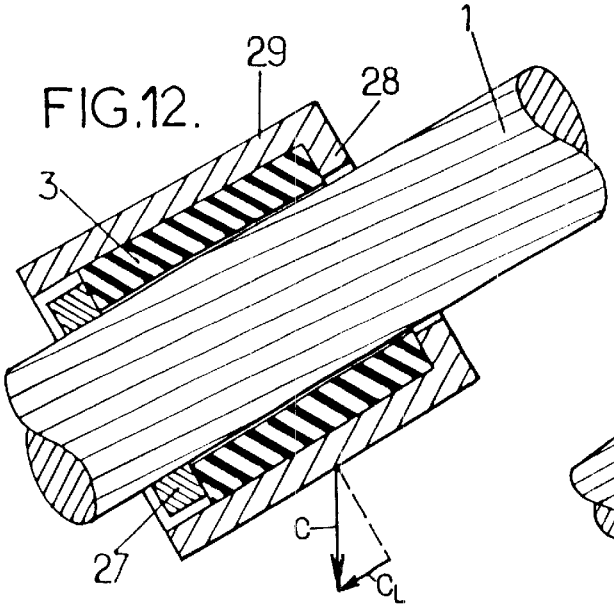
Figure 13:
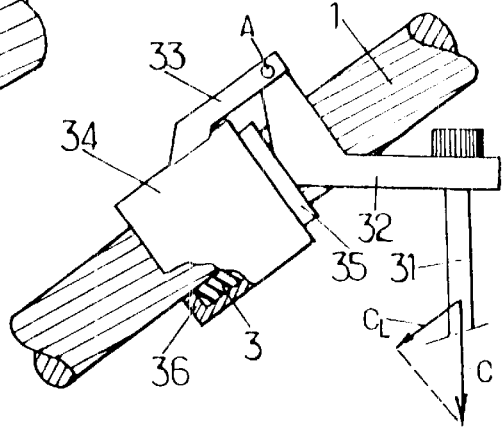
FIG. 13 is a diagram in elevation of another alternative form of embodiment.

FIGS. 12 and 13 show embodiments in which the longitudinal compressive force applied to the deformable structure is the result of a conversion of the longitudinal component of the load C exerted on the cable via the element to be fixed. In the two examples depicted, the cable 1 is in an inclined position and the load C is directed vertically.

In the example of FIG. 12, an annular stop 27 is fixed to the cable 1, exerting modest clamping thereon. The lower end of the deformable structure 3 bears on this stop 27, and its upper end bears on an inner rim 28 integral with the housing 29. The load C transmitted to the housing 29 by the element to be fixed has a longitudinal component $C_L$ directed from the upper end toward the lower end of the deformable structure. This component $C_L$ urges the rim 28 toward the deformable structure 3, which finds itself compressed between the stop 27 and the rim 28. Note that the resistance to slip offered by the device is greater than that offered by the single stop 27 fixed to the cable.

In the case of FIG. 13, the element to be fixed 31 is attached to a lever 32 articulated at its opposite end to a support 33 integral with the housing 34, the axis of articulation A being horizontal and perpendicular to the cable 1. An intermediate area of the lever 32 is applied against a thrust piece 35 penetrating the housing 34, where it exerts the longitudinal compressive force on one end of the deformable structure, the opposite end of which butts against a rim 36 integral with the housing 34, as shown by the cutaway of the housing in the figure. This arrangement transmits the longitudinal component $C_L$ of the load to the deformable structure 3 with an amplification that depends on the dimensions of the lever 32.

Figure 14:
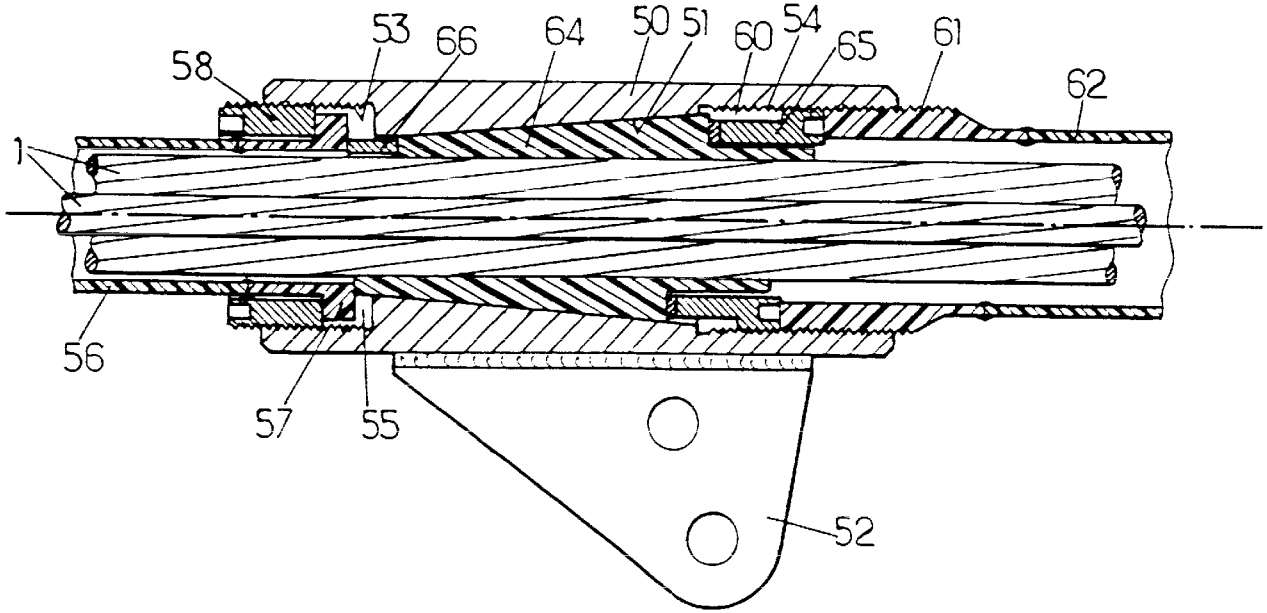
FIG. 14 is a view in longitudinal section of another alternative form of embodiment of a device according to the invention.

In the fixing device depicted in FIG. 14, the housing 50, of cylindrical overall shape, has an axial frustoconical orifice 51 passing through it. In the case of a hanger attachment collar, a rib 52 is welded to the outside of the cylindrical housing 50 to take a yoke fixed to the upper end of the hanger.

The cylindrical housing 50 also comprises two internal screw threads 53, 54, one on each side of the frustoconical orifice 51. The screw thread 53 is formed at the periphery of a cylindrical recess 55 formed above the frustoconical orifice 51 (toward the left in FIG. 13). This orifice 55 receives the lower end of a sheath element 56, equipped with a radial shoulder 57. An externally threaded nut 58 bears against the shoulder 57 and interacts with the screw thread 53 to connect the sheath element 56 to the housing 50.

The screw thread 54 is formed at the periphery of another cylindrical recess 60 formed below the frustoconical orifice 51. This screw thread 54 receives a complementary external screw thread 61 formed at an upper end of another sheath portion 62, so as to connect this sheath portion 62 to the housing 50.

The sheath portions 56, 62 extend between two consecutive collars on the suspension cable. The sheath portions 62 connected to the lower sides of the housings 50 have a diameter slightly greater than that of the sheath portions 56 connected to the upper sides of the housings. These two sheath portions 56, 62 overlap over a certain length in the gap separating two collars. This telescopic overlap allows the sheath to be shortened between the collars to make mounting easier, and allows differential expansions of the materials.

There is thus produced a protective sheath for the suspension cable, which connects continuously at the collars, which affords reliable protection and gives the assembly as a whole a pleasant appearance. Another advantage where needed is that it is possible to blow dry air into the sheath of a suspension bridge suspension cable so as to remove moisture: the embodiment in FIG. 14 makes it possible for the leaktightness required at the attachments of the hangers to be achieved easily while at the same time allowing the air to circulate, whereas achieving this presents serious difficulties in collars of the prior art which consist of several shells bolted together.

The frustoconical orifice 51 of the housing 50 receives a complementary frustoconical jaw 64 which provides the wedging between the cable and the housing. As is commonplace, the jaw 64 may consist of several distinct angular sectors, for example, three of these. Toward the lower side of the housing 50, which corresponds to the largest-diameter end of the orifice and of the frustoconical jaw, the jaw 64 is urged by a nut 65 provided with an external screw thread collaborating with the screw thread 54.

Before the hanger is attached to the plate 52, the nut 65 is screwed into the recess 60 so as to drive the jaw 64 toward the smaller-diameter upper end of the frustoconical orifice 51. The jaw 64 thus finds itself compressed longitudinally between its frustoconical interface with the housing 50 and its rear end urged by the nut 65.

When this tightening is performed, the jaw 64 undergoes longitudinal compression, controlled by the tightening of the nut 65, which results in transverse clamping of the cable 1. By performing this tightening, the housing can be secured in advance to the cable (or the cable to the housing), then the assembly can be set in place while maintaining the positioning of the components. When the load is then transmitted by the attaching of the hangers, the longitudinal compressive force increases because of the load transmitted by the housing 50 (to the right in FIG. 14) and the positioning is unchanged.

Furthermore, the fixing device according to FIG. 14 is always in a safe condition, because of the self-wedging operation, including in cases when there might be a slight upward movement of the hanger. The setup is also self-wedging in the event of accidental overload on the hanger.

The load transmitting nut 65 is tightened using an appropriate tool, such as a pin wrench, to a torque that is predefined so as to ensure sufficient clamping between the cable 1 and the housing 50.

In the case of a multi-strand cable, the effectiveness of the clamping may be increased by filling the gaps between the strands using curved plastic inserts (see EP-A-0 789 110). In order to increase the coefficient of friction between the stands and/or between the strands and the jaws, it is also possible to place a fiberglass fabric around the strands.

To limit the creep of the frustoconical jaw 64, the latter may be made of plastic, for example HDPE or polyamide, and the volume it occupies is confined.

Once the controlled clamping has been exerted using the nut 65, steps are taken to avoid additional creepage of the material of the jaw 64. To do that, the jaw is confined as far as possible within its frustoconical housing. Use may in particular be made of a wedge 66, depicted in the upper part of FIG. 14, which is applied against the smallest-section end of the jaw 64 after clamping, so as to block off this end and prevent excess creep of the jaw material. On the opposite side, the nut 65 has a configuration capable also of avoiding the creep of the material of the jaw.

In order to assemble the bearing structure of a suspension bridge produced using fixing devices according to FIG. 14, the procedure is as follows:

- the sheath portions 56, 62 are cut and the connecting pieces comprising the rims 57 and the screw thread 61 are welded to their ends;

the strands that make up the cable 1 are cut to the exact length;

the position of each housing 50 for attaching the hangers 41 and/or for fitting to the tops of the towers 40 is marked precisely on the strands;

the sheath portions 56, 62, the nuts 58, 65, the jaws 64, the housings 50 and the optional wedges 66 are slipped over the cable in the appropriate order from one or both ends of the cable;

each housing 50 is brought to the specified location on the cable and once the jaw 64 has been engaged in its orifice 51, it is driven in by applying the required clamping using the nut 65;

once the nut 65 has been tightened, the end of the sheath element 56 and the optional wedge 66 are engaged in the recess 55, and this sheath element 56 is connected to the housing 50 by means of the nut 58; on the opposite side of the housing 50, the sheath element 62 is also engaged by screwing its threaded end 61 into the recess 60;

once all the housings have been fitted in this way, the cable is installed in position on the towers, and the ends of the strands are anchored then the hangers are attached.

By virtue of the fixing system used, this approach allows precise and reliable assembly of the bearing structure.

It is to be noted that the same approach affords similar advantages of reliability and of precision when use is made of a device according to one of FIGS. 1 to 11, in which a deformable wedging structure is used in place of a frustoconical jaw.

This also produces an assembly which is relatively attractive by virtue of the continuity of the connection of the sheath portions 56, 62. However, it will be noted that this protective sheath 56, 62 is optional. In another embodiment, appropriate particularly in the case of total prefabrication, the sheath portions run as a single piece from one collar to another, thus improving sealing.

Figure 15:
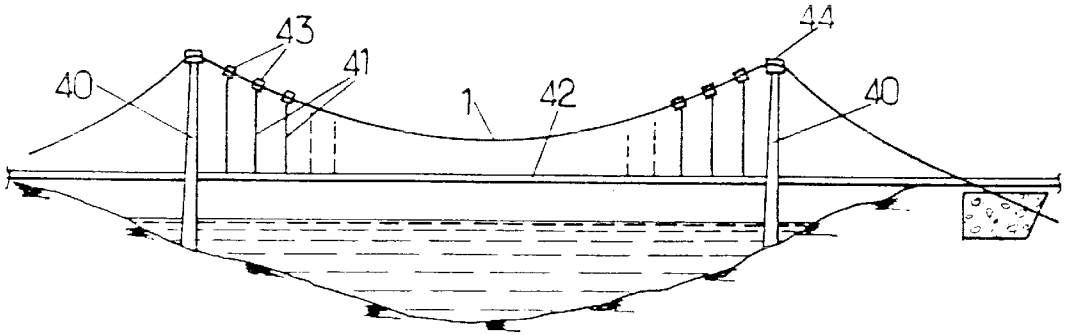
FIG. 15 is a diagram of a suspension bridge according to the invention.

FIG. 15 schematically illustrates a suspension bridge having one or more suspension cables 1 equipped with fixing devices according to the invention. The suspension cable 1 is anchored at the two ends of the bridge, and passes over towers 40. Hangers 41 are attached to the suspension cable to support the deck 42 of the bridge. The hangers 41 are fixed to the suspension cable at their upper ends which are attached to housings 43 forming part of fixing devices of the type described hereinabove. These device prevent the vertical hangers 41 from sliding along the cable under the effect of the component parallel to the cable of the load exerted vertically by the deck 42. In the case of a suspension bridge with no hangers, the construction element connected to the housing 43 may be directly a section integral with the deck.

The suspension cable 1 is deflected at the top of the towers 40, where the tensile force may be asymmetric. It may thus be necessary for the cable to immobilized to prevent it from slipping with respect to the towers. To do that, housings 44 which surround the cable 1 are installed at the tops of the towers 40 so as to immobilize the cable with respect to the towers as described hereinabove.

What is claimed is:

1. Device for fixing together a construction element and a structural cable, comprising a rigid housing connected to the construction element and surrounding the cable, a wedging structure arranged between the cable and the housing, and load transmitting means arranged to exert a longitudinal compressive force, parallel to the cable, on the wedging structure, the wedging structure being pressed against the cable and the housing under the action of the longitudinal compressive force, so as to offer resistance to movement of the housing and of the construction element parallel to the cable, wherein the housing is a one-piece part which completely surrounds a portion of the cable.

2. Device according to claim 1, wherein the wedging structure comprises at least one deformable material.

3. Device according to claim 2, wherein the wedging structure comprises a plurality of portions made of deformable material arranged in the longitudinal direction and separated by inserts running radially between the cable and the housing.

4. Device according to claim 1, wherein the wedging structure comprises a frustoconical jaw engaged in a complementary frustoconical orifice formed inside the housing, and the load transmitting means are applied against an end of largest section of the frustoconical jaw so as to urge the jaw toward an end of smallest section of the frustoconical orifice.

5. Device according to claim 4, wherein only one end of the housing has a frustoconical orifice receiving a jaw urged toward the opposite end of the housing.

6. Device according to claim 4, wherein the jaw is made of plastic.

7. Device according to claim 4, comprising at least one wedge applied against an end of smallest section of the frustoconical jaw.

8. Device according to claim 1, wherein the housing is provided with means of continuous connection of an outer sheath surrounding the cable.

9. Device according to claim 8, wherein the connecting means comprise, on the one hand, a first internal screw thread formed at a first end of the housing receive an end of a first sheath portion and an externally threaded nut for fixing said first sheath portion to the housing and, on the other hand, a second internal screw thread formed at an opposite end of the housing to receive an externally threaded end of a second sheath portion.

10. Device according to claim 1, wherein the load transmitting means comprise at least one member running parallel to the cable, tensioned by clamping means so as to exert the longitudinal compressive force on the ends of the wedging structure.

11. Device according to claim 10, wherein said member extends through the wedging structure.

12. Device according to claim 10, wherein said member extends around the wedging structure, through or around the outside of the housing.

13. Device according to claim 1, wherein the load transmitting means comprise at least one nut screwed into a screw thread integral with the housing and applied against an end of the wedging structure.

14. Device according to claim 1, wherein the load transmitting means are arranged to convert a longitudinal component of a load exerted on the cable by the construction element into a longitudinal compression of the wedging structure.

15. Device according to claim 14, wherein the load transmitting means comprise a stop fixed to the cable, against which a first end of the wedging structure bears, and a part integral with the housing bearing against a second end of the wedging structure opposite the first end, the longitudinal component of the load exerted on the cable by the construction element being directed from the second end toward the first end.

16. Device according to claim 14, wherein the housing has an internal rim against which a first end of the wedging structure bears, and wherein the load transmitting means comprise a lever articulated to a part integral with the housing, by means of which the construction element is connected to the housing, and a transmission member bearing against a second end of the wedging structure opposite the first end and to which a portion of the lever applies the longitudinal compressive force in response to the load exerted by the construction element.

17. Device according to claim 1, wherein a fiberglass fabric is inserted between the cable and the wedging structure and/or between the constituent strands of the cable.

18. Device according to claim 1, wherein the cable is protected by at least one plastic sheath, and wherein a rigid intermediate layer is arranged between the wedging structure and the cable sheath.

19. Device according to claim 18, wherein the wedging structure is deformable and wherein the intermediate layer exhibits, toward the deformable wedging structure, reliefs transversal to a direction of the cable.

20. Device according to claim 18, wherein the rigid intermediate layer has an external radial rim against which a first end of the wedging structure is applied, wherein said rim of the rigid intermediate layer is axially in abutment against an internal radial rim of the housing, and wherein the load transmitting means comprise means for compressing the wedging structure by urging a second end of the wedging structure opposite the first end toward said rims.

21. Method for fixing a construction element to a structural cable, comprising the steps of:

placing around the cable a rigid housing for transmitting a load from the construction element to the cable, the rigid housing consisting of a one-piece part which completely surrounds a portion of the cable;

placing a wedging structure between the cable and the housing; and compressing the wedging structure longitudinally, parallel to the cable, before the load of the construction element is applied, so that the wedging structure is pressed against the cable and the housing to offer resistance to movement of the housing and of the construction element parallel to the cable.

22. Method according to claim 21, wherein the wedging structure comprises at least one deformable material.

23. Method according to claim 21, wherein the wedging structure comprises a frustoconical jaw engaged in a complementary frustoconical orifice formed inside the housing, and wherein the frustoconical jaw is compressed longitudinally by applying, to a largest-section end thereof, a force to drive it in toward a smallest-section end of the frustoconical orifice.

24. Method according to claim 23, wherein a jaw is engaged into a single end of the housing, the jaw being urged toward an opposite end of the housing.

25. Method for fixing a structural cable to a construction element, comprising the steps of:

placing around the cable a rigid housing for transmitting a load from the cable to the construction element, the rigid housing consisting of a one-piece part which completely surrounds a portion of the cable;

placing a wedging structure between the cable and the housing; and compressing the wedging structure longitudinally, parallel to the cable, before the load is applied, so that the wedging structure is pressed against the cable and the housing to offer resistance to movement of the cable with respect to the housing and to the construction element.

26. Method according to claim 25, wherein the wedging structure comprises at least one deformable material.

27. Method according to claim 25, wherein the wedging structure comprises a frustoconical jaw engaged in a complementary frustoconical orifice formed inside the housing, and wherein the frustoconical jaw is compressed longitudinally by applying, to a largest-section end thereof, a force to drive it in toward a smallest-section end of the frustoconical orifice.

28. Method according to claim 27, wherein a jaw is engaged into a single end of the housing, the jaw being urged toward an opposite end of the housing.

29. Suspension bridge comprising at least one suspension cable, construction elements for supporting a deck of the bridge, and means for fixing at least some of the construction elements to the suspension cable, wherein the fixing means comprise at least one device for fixing together one of the construction elements and the cable, said device comprising a rigid housing connected to said one of the construction elements and surrounding the cable, a wedging structure arranged between the cable and the housing, and load transmitting means arranged to exert a longitudinal compressive force, parallel to the cable, on the wedging structure, the wedging structure being pressed against the cable and the housing under the action of the longitudinal compressive force, so as to offer resistance to movement of the housing and of the construction element parallel to the cable, and wherein the housing is a one-piece part which completely surrounds a portion of the cable.

30. Suspension bridge according to claim 29, wherein the construction elements fixed with respect to the suspension cable by means of said devices comprise a top of at least one tower of the bridge where the suspension cable is deflected.

31. Suspension bridge according to claim 29, wherein the construction elements fixed with respect to the suspension cable by means of said devices comprise hangers connected to the deck of the bridge.

32. Suspension bridge according to claim 29, wherein the construction elements fixed with respect to the suspension cable by means of said devices comprise sections of the deck of the bridge.

* * * * *